US008186779B2

(12) United States Patent
Chen et al.

(10) Patent No.: US 8,186,779 B2
(45) Date of Patent: May 29, 2012

(54) SLIDE ASSEMBLY WITH SECURITY DEVICE

(75) Inventors: Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 358 days.

(21) Appl. No.: 12/633,009

(22) Filed: Dec. 8, 2009

(65) Prior Publication Data

US 2011/0135227 A1 Jun. 9, 2011

(51) Int. Cl.
*A47B 88/04* (2006.01)

(52) U.S. Cl. ..... 312/334.47; 312/319.1; 312/334.44; 312/333

(58) Field of Classification Search ..... 312/330.1, 312/334.1, 333, 334.7, 334.8, 334.11, 334.44, 312/334.45, 334.46, 334.47, 319.1; 384/18, 384/19, 20, 21

See application file for complete search history.

(56) References Cited

U.S. PATENT DOCUMENTS

| | | | | |
|---|---|---|---|---|
| 4,423,914 | A * | 1/1984 | Vander Ley | 312/333 |
| 5,169,238 | A * | 12/1992 | Schenk | 384/21 |
| 6,126,255 | A * | 10/2000 | Yang | 312/334.46 |
| 6,367,899 | B1 * | 4/2002 | Hwang et al. | 312/334.47 |
| 7,357,468 | B2 * | 4/2008 | Hwang et al. | 312/333 |
| 2004/0174100 | A1 * | 9/2004 | Chen et al. | 312/333 |
| 2009/0096340 | A1 * | 4/2009 | Chen et al. | 312/334.46 |

* cited by examiner

*Primary Examiner* — James O Hansen
*Assistant Examiner* — Sasha T Varghese
(74) *Attorney, Agent, or Firm* — Rosenberg, Klein & Lee

(57) ABSTRACT

A slide assembly with a security device includes a first slide member, a second slide member, first and second stop members and an elastic member. The first slide member has a guiding passage. The first and second stop members are located on the first slide member. The first and second stop members each include an engaging portion and a stop portion. The engaging portions and the stop portions of the first and second stop members are in the guiding passage. The elastic member is connected to the first and second stop members. The stop portions contact against first and second stop walls. The first and second stop members are moved from the guiding passage when the second slide member is inserted in the first slide member via the guiding passage, so that the second slide member may be connected to the first slide member correctly.

10 Claims, 12 Drawing Sheets

SLIDE ASSEMBLY WITH SECURITY DEVICE

FIELD OF THE INVENTION

The present invention relates to a slide assembly with a security device, and more particularly, to a security device for controlling correct installation between slide members of the slide assembly.

BACKGROUND OF THE INVENTION

A conventional slide assembly is shown in FIG. 12 and generally includes a first slide member 1 and a second slide member 2 which is slidably connected to the first slide member 1, wherein the second slide member 2 can be disengaged from the first slide member 1, and re-installed to the first slide member 1. Generally, the slide assembly can be used for server racks, cabinets or the like having retractable objects. For example, the first slide member can be connected to a rack, a cabinet or a fixed object, and the second slide member can be connected to a chassis, a drawer or a movable object. By this arrangement, the chassis, drawer or movable object can be pulled out relative to the rack, the cabinet or the fixed object.

However, the conventional slide assembly lacks a security device which prevents the second slide member 2 from being incorrectly installed to the first slide member 1. When the slide assembly bears a load, the chassis or the drawer, the chassis or the drawer may drop from the rack or the cabinet when being pulled and cause damage.

The situation that the second slide member 2 is not correctly installed to the first slide member 1 is disclosed in FIG. 13, wherein a bottom rail 3 of the second slide member 2 is correctly connected to the lower portion of the guiding passage 4 of the first slide member 1, but a top rail 5 of the second slide member 2 is not correctly engaged with the top portion of the guiding passage 4, such that there is an unstable support to the second slide member 2 and it is not safe when a load is supported by the second slide member 2.

Therefore, a security device is needed to improve the shortcoming of the conventional slide assembly.

SUMMARY OF THE INVENTION

The present invention intends to provide a security device for a slide assembly so as to ensure the first and second slide member are correctly connected to each other and prevent from possible injury or damage when using the slide assembly.

The present invention relates to a slide assembly and comprises a first slide member which includes a first wall, a second wall and a connection board connected between the first and second walls. A first passage and a second passage are defined by the first wall, the second wall and the connection board so as to accommodate rolling mediums. A guiding passage is defined between the rolling mediums of the first passage and the rolling mediums of the second passage. A second slide member includes a top wall, a bottom wall and a side board connected between the top and bottom walls. A first guiding surface is defined by the top wall and a second guiding surface is defined by the bottom wall. The second slide member is inserted in the first slide member via the guiding passage. The first and second guiding surfaces are contact with the rolling mediums of the first and second passages so that the second slide member is slidable relative to the first slide member. A first stop member is movably located at an initial end of the first slide member and the second slide member is slidably connected to the first slide member from the initial end. The first stop member includes a first engaging portion and a first stop portion located opposite to the first engaging portion. The first engaging portion and the first stop portion of the first stop member are located corresponding to the guiding passage of the first slide member. A second stop member is movably located at the initial end of the first slide member and the second slide member is slidably connected to the first slide member from the initial end. The second stop member includes a second engaging portion and a second stop portion located opposite to the second engaging portion. The second engaging portion and the second stop portion of the second stop member are located corresponding to the guiding passage of the first slide member. An elastic member is connected to the first and second stop members to keep the first engaging portion and the first stop portion of the first stop member to be located corresponding to the guiding passage of the first slide member, and the second engaging portion and the second stop portion of the second stop member to be located corresponding to the guiding passage of the first slide member. A first stop wall is located corresponding to the second stop portion of the second stop member and a second stop wall is located corresponding to the first stop portion of the first stop member so as to position the second stop portion and the first stop portion. When the second slide member is inserted in the first slide member via the guiding passage, the first engaging portion and the second engaging portion of the first and second stop members are pushed to disengage from the guiding passage by the second slide member. The first stop portion of the first stop member is disengaged from the guiding passage of the first slide member and the second stop portion of the second stop member is disengaged from the guiding passage of the first slide member.

Preferably, the first and second stop members are pivotably connected to the first slide member, and the first and second stop members are crosswise connected to each other.

Preferably, the first engaging portion of the first stop member is located corresponding to the top wall of the second slide member and the second engaging portion of the second stop member is located corresponding to the bottom wall of the second slide member.

Preferably, a fixing plate is fixed to the first slide member and the first and second stop members are pivotably connected to the fixing plate, so that the first engaging portion and the first stop portion of the first stop member and the second engaging portion and the second stop portion of the second stop member are movable relative to the first slide member.

Preferably, the first stop member has a first pivot hole located between the first engaging portion and the first stop portion, and the second stop member has a second pivot hole located between the second engaging portion and the second stop portion. The first and second stop members are pivotably connected to the fixing plate by the first and second pivot holes.

Preferably, the elastic member includes a first portion, a second portion located corresponding to the first portion and a middle portion connected between the first and second portions. A biasing force is formed between the first and second portions. The middle portion is connected to the first slide member. The first portion is connected to the first stop member. The second portion is connected to the second stop member.

Preferably, a first support member is fixed to the first slide member close to the first wall, and includes a first guiding portion, a first chamber and a second chamber. The first guiding portion is contact with the first guiding surface of the second slide member. The first chamber accommodates the first engaging portion of the first stop member. The second chamber accommodates the second stop portion of the second stop member. The first stop wall is located adjacent to the second chamber. A second support member is fixed to the first slide member close to the second wall, and includes a second guiding portion, a third chamber and a fourth chamber. The second guiding portion is contact with the second guiding surface of the second slide member. The third chamber accommodates the second engaging portion of the second stop member. The fourth chamber accommodates the first stop portion of the first stop member. The second stop wall is located adjacent to the fourth chamber.

Preferably, the first and second support members are combined to be a main support member which includes a bridge portion. The first and second stop members are movably connected to the bridge portion so as to be movable relative the first slide member.

Preferably, the first and second stop walls are disposed on the first slide member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
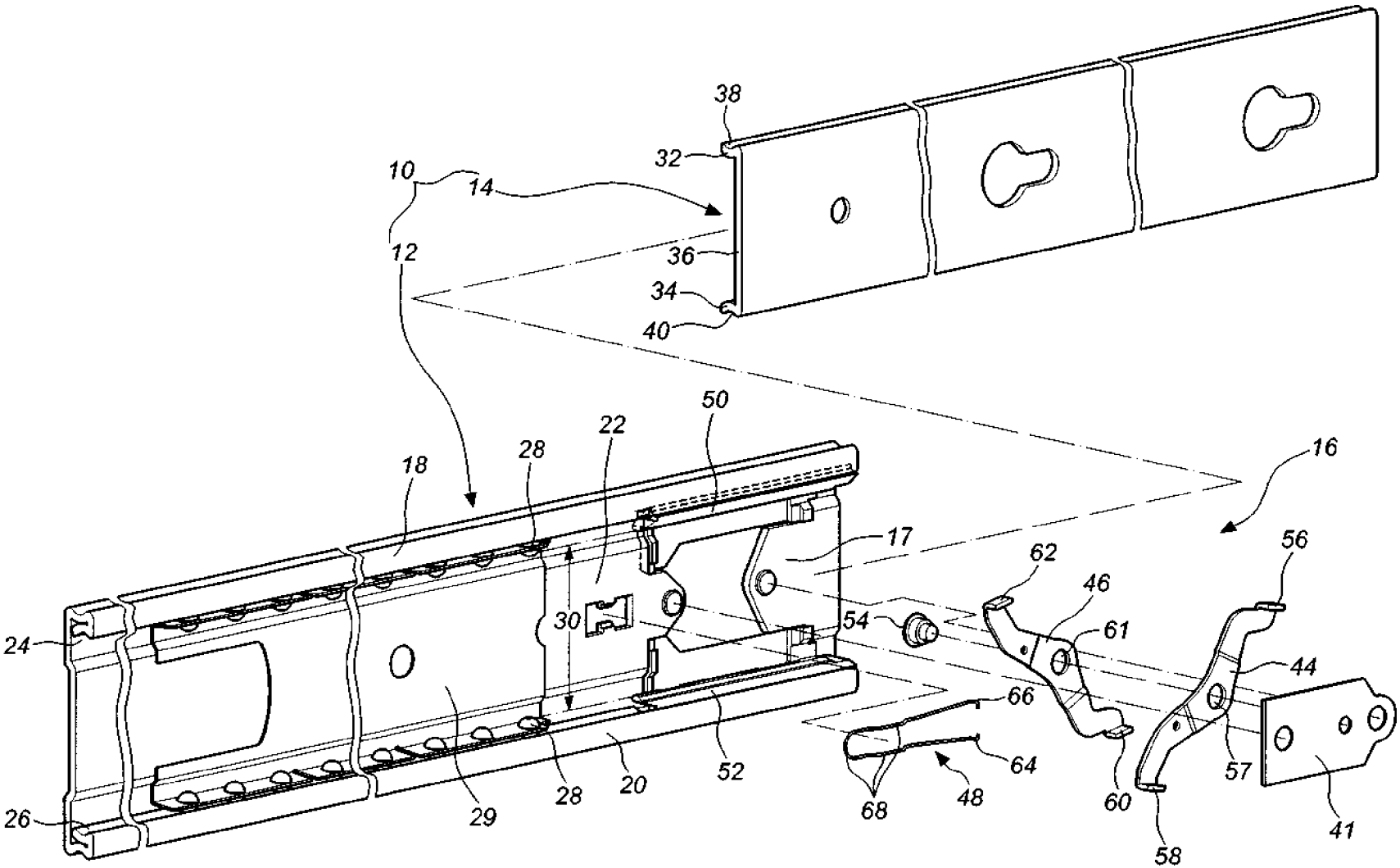
FIG. 1 is an exploded view to show the slide assembly and the security device according to a first embodiment of the present invention.
Figure 2:
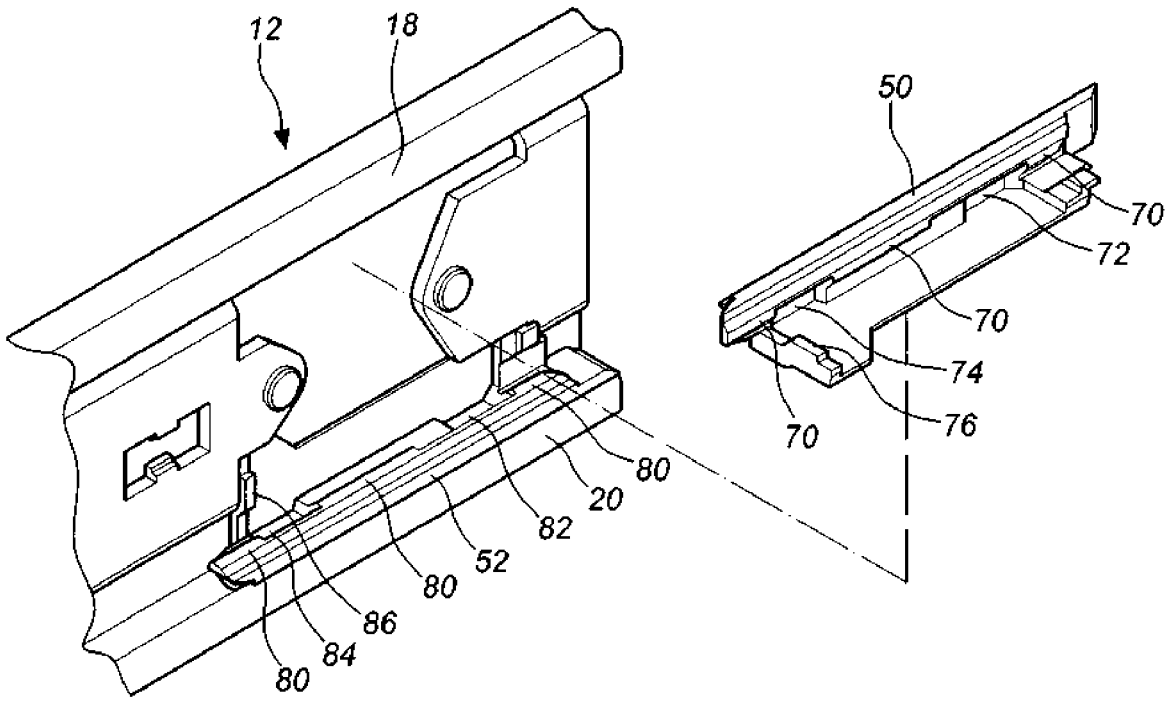
FIG. 2 is a perspective view to show that two support members are connected to the slide assembly of the present invention.

Referring to FIGS. 1 and 2, the slide assembly 10 of the present invention comprises a first slide member 12 and a second slide member 14 which is longitudinally and movably connected to the first slide member 12. A security device 16 is connected to an initial end 17 of the first slide member 12, where the second slide member 14 is inserted therefrom.

The first slide member 12 includes a first wall 18, a second wall 20 and a connection board 22 which is connected between the first and second walls 18, 20. A first passage 24 is defined between the first wall 18 and the connection board 22. A second passage 26 is defined between the second wall 20 and the connection board 22. The first passage 24 and the second passage 26 are adapted for accommodating rolling mediums 28 therein. The rolling mediums 28 can be a plurality of balls. A retainer 29 is used to position the balls. In this embodiment, a guiding passage 30 is defined between the mediums 28 of the first passage 24 and the mediums 28 of the second passage 26.

The second slide member 14 includes a top wall 32, a bottom wall 34 and a side board 36 connected between the top and bottom walls 32, 34. A first guiding surface 38 is defined by the top wall 32 and a second guiding surface 40 is defined by the bottom wall 34. The second slide member 14 is inserted in the first slide member 12 through the guiding passage 30. The first and second guiding surfaces 38, 40 are contact with the mediums 28 of the first and second passages 24, 26 so that the second slide member 14 is slidable relative to the first slide member 12.

The security device 16 includes a fixing plate 41 fixed to the first slide member 12. A first stop member 44 and a second stop member 46 are connected to the fixing plate 41. An elastic member 48 is connected to the first and second stop members 44, 46. A first support member 50 and a second support member 52 are connected to the first slide member 12.

The first stop member 44 is movably connected to the fixing plate 41. For example, the first stop member 44 is pivotally connected to the fixing plate 41 with a pivotal member 54. The first stop member 44 includes a first engaging portion 56, a first stop portion 58 opposite to the first engaging portion 56, and a first pivot hole 57 disposed between the first engaging portion 56 and the first stop portion 58. The first engaging portion 56 and the first stop portion 58 of the first stop member 44 are located corresponding to the guiding passage 30 of the first slide member 12. Preferably, the first engaging portion 56 of the first stop member 44 is located corresponding to the top wall 32 of the second slide member 14.

Figure 3:
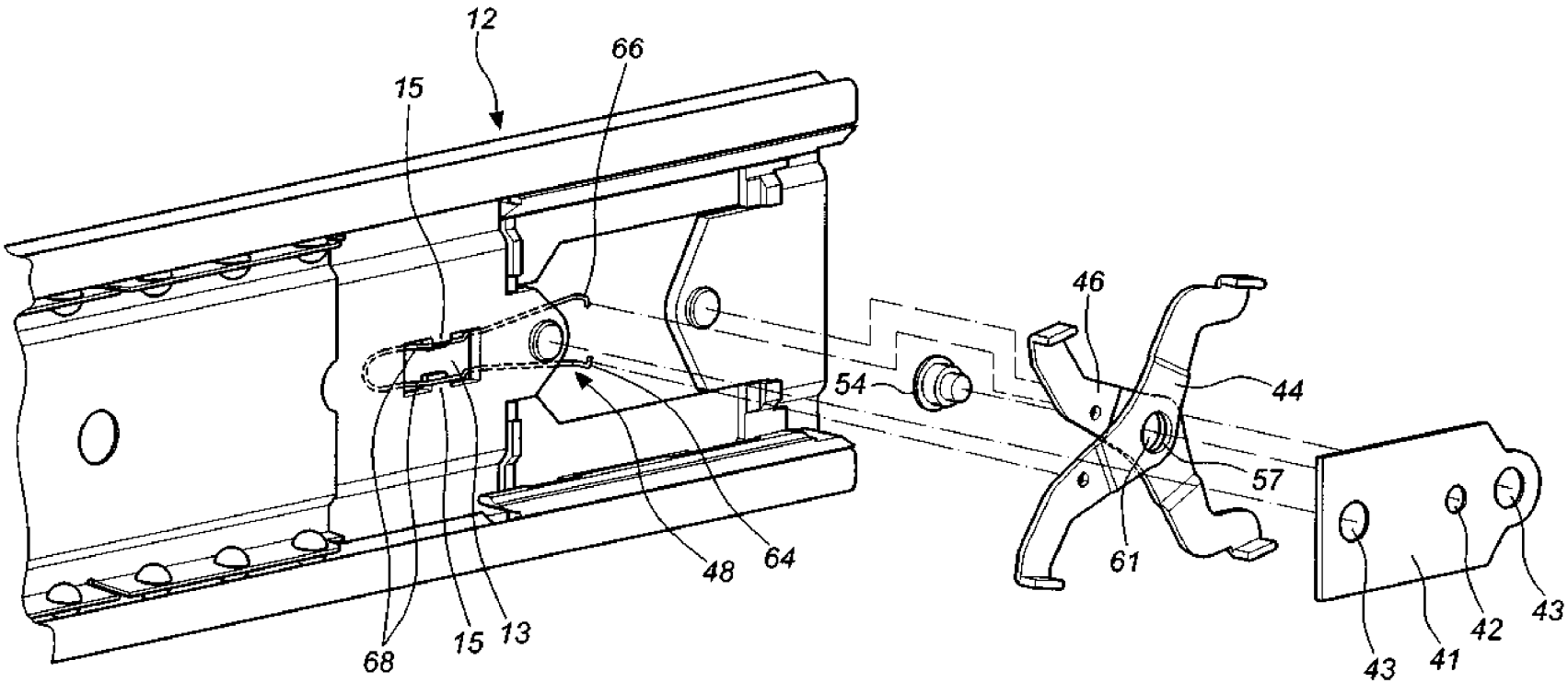
FIG. 3 shows that the first and second stop members and the fixing plate of the security device are to be connected to the slide assembly of the present invention.

The second stop member 46 is movably connected to the fixing plate 41 by using the pivotal member 54 to pivotably connect the second stop member 46 to the fixing plate 41. The second stop member 46 includes a second engaging portion 60, a second stop portion 62 opposite to the second engaging portion 60, and a second pivot hole 61 disposed between the second engaging portion 60 and the second stop portion 62. The second engaging portion 60 and the second stop portion 62 of the second stop member 46 are located corresponding to the guiding passage 30 of the first slide member 12. Preferably, the second engaging portion 60 of the second top member 46 is located corresponding to the bottom wall 34 of the second slide member 14. In this embodiment, as shown in FIG. 3, the first and second stop members 44, 46 are pivotably connected to the fixing plate 41 by inserting the pivotal member 54 through the first and second pivot holes 57, 61 and to connect with the fixing hole 42 in the fixing plate 41. The first and second stop members 44, 46 are crosswise connected to each other. The fixing plate 41 has a through hole 43 so as to be riveted to the first slide member 12, such that the first and second stop members 44, 46 are rotatable relative to the first slide member 12.

The elastic member 48 includes a first portion 64, a second portion 66 located corresponding to the first portion 64, and a middle portion 68 connected between the first and second portions 64, 66. A biasing force is formed between the first and second portions 64, 66. The middle portion 68 is connected to the first slide member 12, as shown in FIG. 3. The first slide member 12 includes a positioning hole 13 and two engaging bits 15 extending into the positioning hole 13 from the first slide member 12, so that the middle portion 68 can be inserted into the positioning hole 13 and engaged with the two engaging bits 15. The first portion 64 of the elastic member 48 is connected to the first stop member 44, and the second portion 66 is connected to the second stop member 46, so that the first and second stop members 44, 46 are maintained to be located corresponding to the guiding passage 30 of the first slide member 12 by the force of the elastic member 48.

Figure 4:
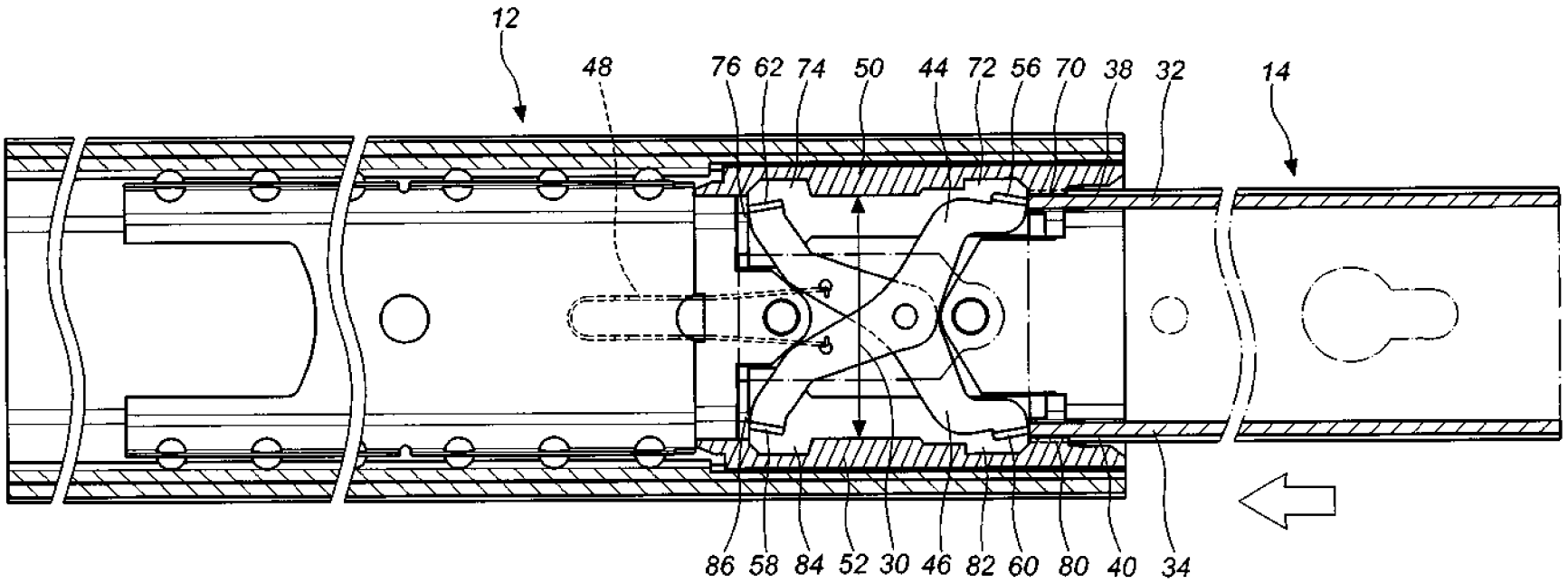
FIG. 4 is a cross sectional view to show that the second slide member is inserted in the first slide member to be contact with the security device of the present invention.

The first support member 50 is fixed to the first slide member 12 and located close to the first wall 18. The first support member 50 includes a first guiding portion 70 located corresponding to the first guiding surface 38 of the second slide member 14, a first chamber 72 and a second chamber 74 located corresponding to the first guiding portion 70, and a first stop wall 76 adjacent to the second chamber 74. When the second slide member 14 is inserted in the first slide member 12, as shown in FIG. 4, the first guiding portion 70 of the first support member 50 will be contact with the first guiding surface 38 of the second slide member 14 for guiding the second slide member 14 to be inserted in the first slide member 12. The first stop wall 76 is adapted to hold against the second stop member 46 so as to position the second stop portion 62 thereat.

The second support member 52 is fixed to the first slide member 12 and located close to the second wall 20. The second support member 52 includes a second guiding portion 80 located corresponding to the second guiding surface 40 of the second slide member 14, a third chamber 82 and a fourth chamber 84 located corresponding to the second guiding portion 80, and a second stop wall 86 adjacent to the fourth chamber 84. When the second slide member 14 is inserted in the first slide member 12, as shown in FIG. 4, the second guiding portion 80 of the second support member 52 will be contact with the second guiding surface 40 of the second slide member 14 so as to guide the second slide member 14 to be inserted in the first slide member 12. The second stop wall 86 is adapted to hold against the first stop member 44 so as to position the first stop portion 58 thereat.

Figure 5:
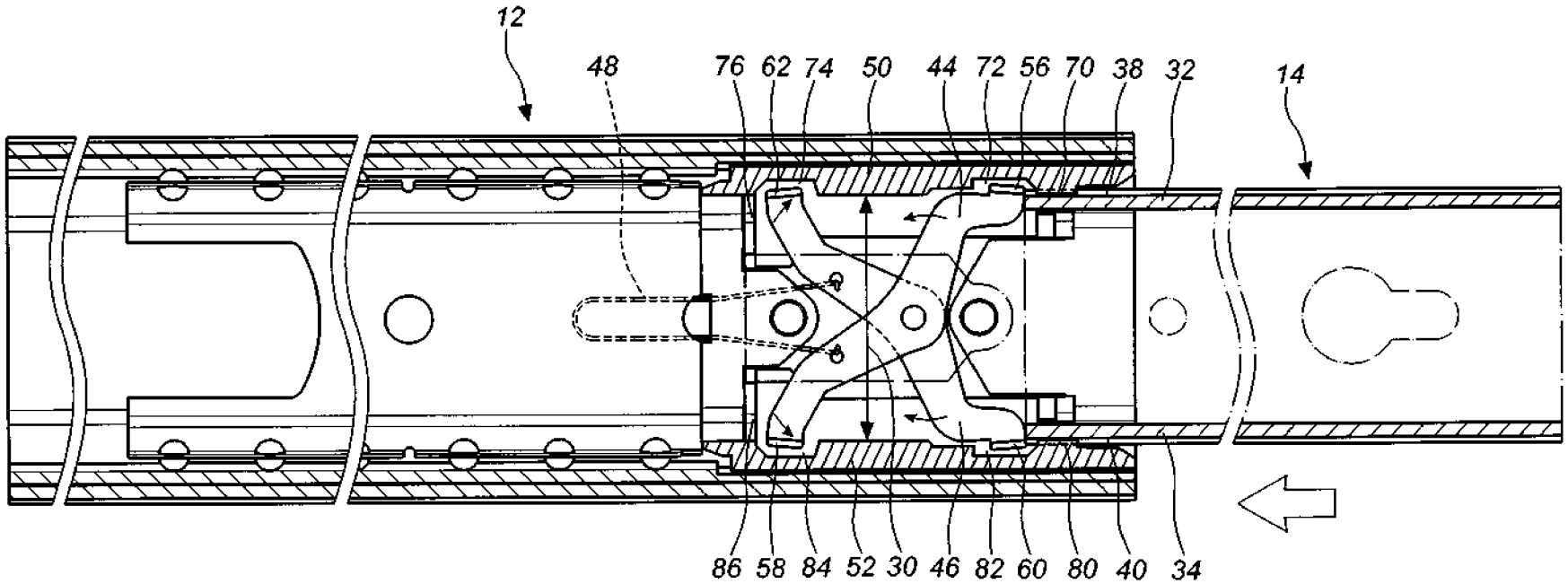
FIG. 5 is a cross sectional view to show that the security device is pushed to swing an angle by the second slide member.
Figure 6:
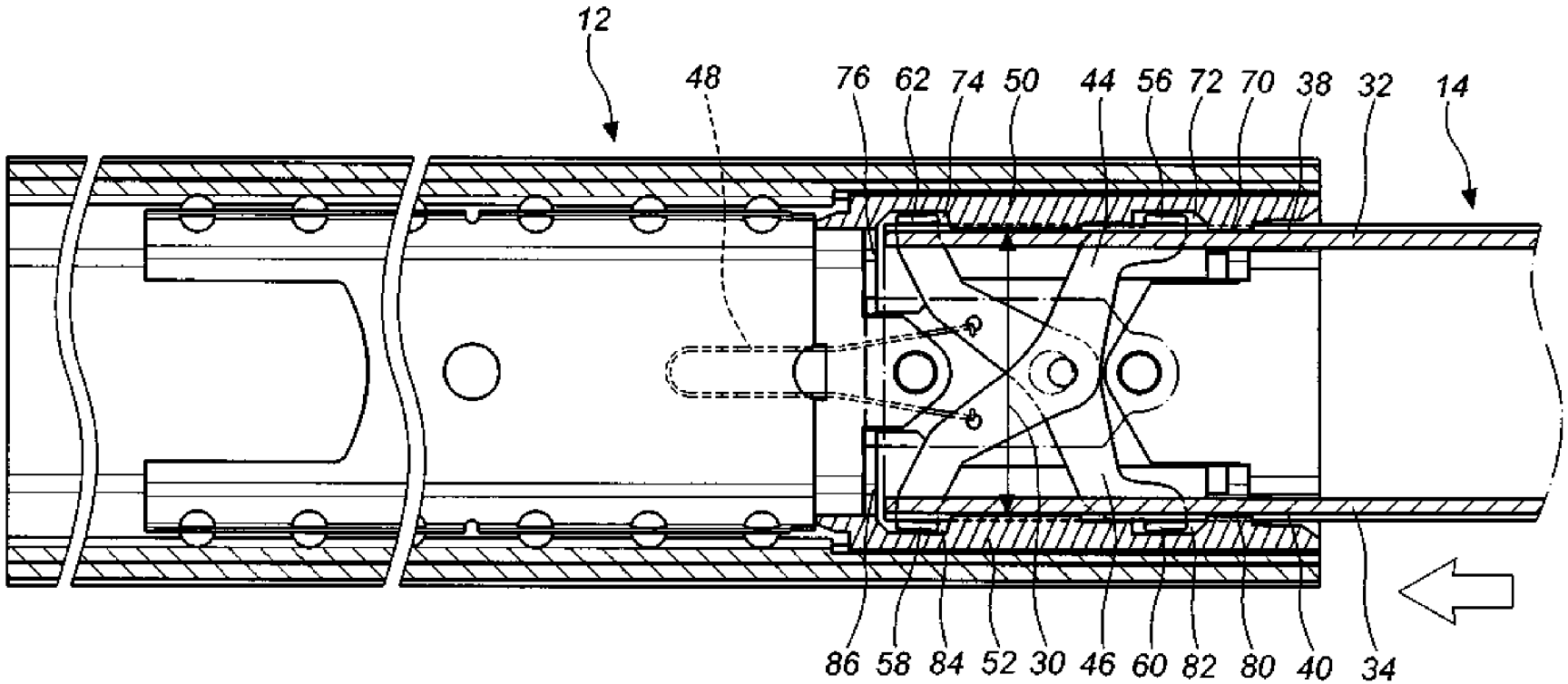
FIG. 6 shows that the second slide member is correctly connected to the first slide member and moves relative to the first slide member.

As shown in FIG. 4 to FIG. 6, when the second slide member 14 is inserted in the first slide member 12, the first and second guiding surfaces 38, 40 of the second slide member 14 are correctly inserted in the guiding passage 30 of the first slide member 12. The first guiding portion 70 of the first support member 50 and the second guiding portion 80 of the second support member 52 guide the first guiding surface 38 and the second guiding surface 40 of the second slide member 14. The first engaging portion 56 of the first stop member 44 and the second engaging portion 60 of the second stop member 46 are pivoted an angle by the top wall 32 and the bottom wall 34 of the second slide member 14. As shown in FIGS. 5 and 6, the first engaging portion 56 of the first stop member 44 enters the first chamber 72 of the first support member 50 and the first stop portion 58 of the first stop member 44 enters the fourth chamber 84 of the second support member 52. Therefore, the first engaging portion 56 and the first stop portion 58 of the first stop member 44 are moved from the guiding passage 30 of the first slide member 12 and do not block the second slide member 14. In the meanwhile, the second engaging portion 60 of the second stop member 46 enters the third chamber 82 of the second support member 52 and the second stop portion 62 of the second stop member 46 enters the second chamber 74 of the first support member 50. Therefore, the first stop portion 58 of the first stop member 44 and the second stop portion 62 of the second stop member 46 both are moved from the guiding passage 30 of the first slide member 12 and do not block the bottom wall 34 and the top wall 32 of the second slide member 14. The second slide member 14 can be continuously inserted in the first slide member 12, as shown in FIG. 6. By using the mechanism, as long as the second slide member 14 can be partially inserted into the first slide member 12, the first and second guiding surfaces 38, 40 of the second slide member 14 can be contact with the first guiding portion 70 of the first support member 50 and the second guiding portion 80 of the second support member 52. The second slide member 14 is then correctly and normally inserted into the guiding passage 30 of the first slide member 12.

Figure 7:
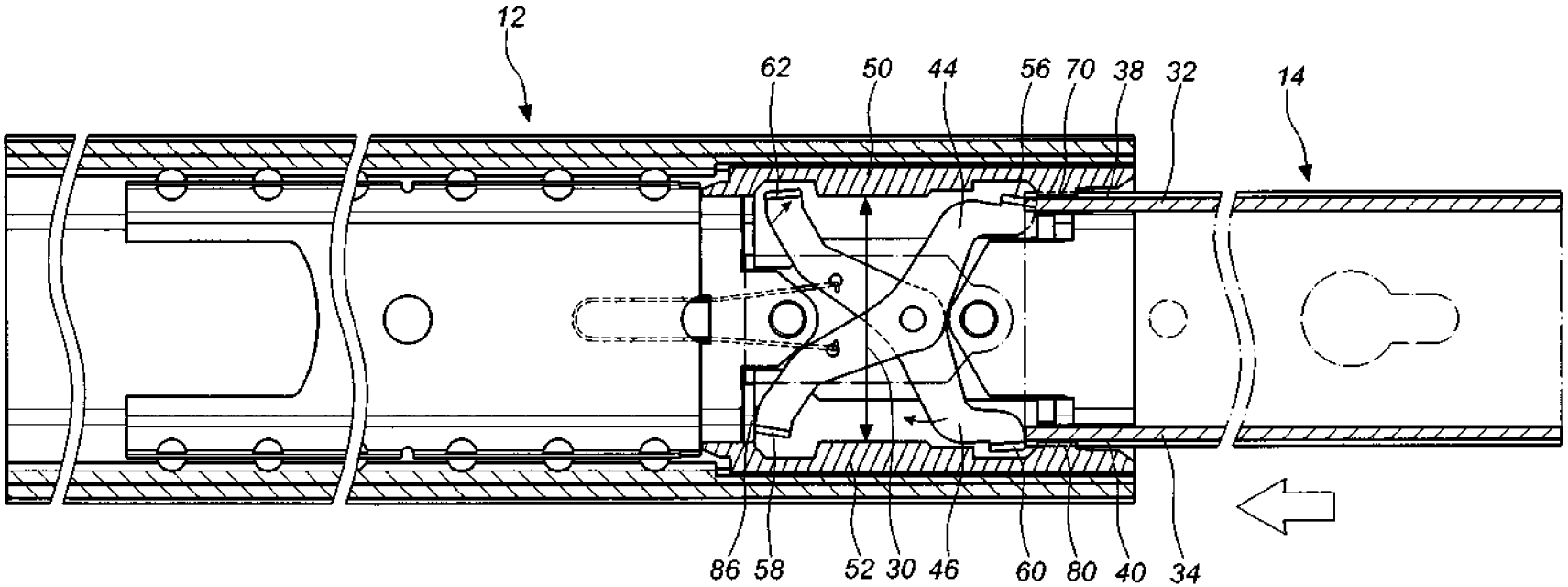
FIG. 7 shows that the second slide member is incorrectly connected to the first slide member and contacts a part of the security device of the present invention.
Figure 8:
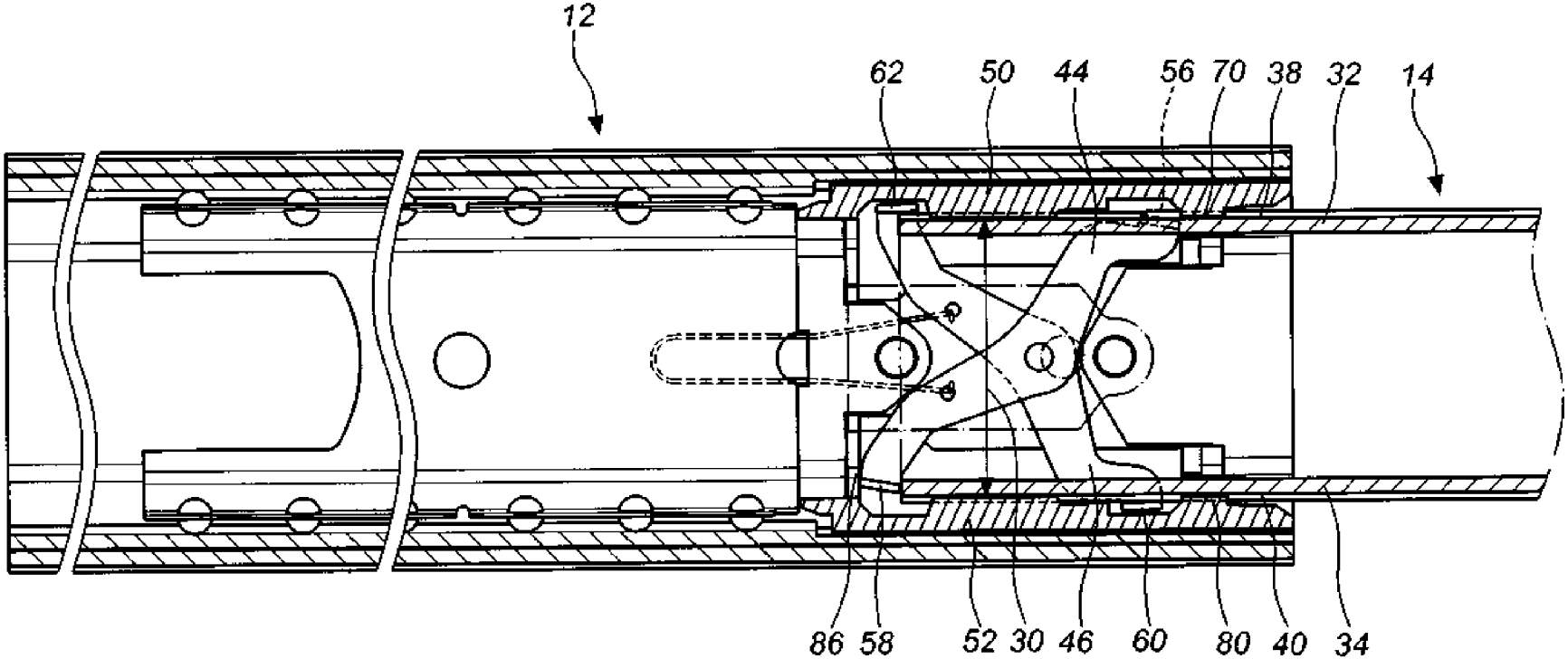
FIG. 8 shows that the second slide member is incorrectly connected to the first slide member and stopped by the security device of the present invention.

On the contrary, as shown in FIG. 7, when the second slide member 14 is not correctly connected to the first slide member 12, for example, only the bottom wall 34 of the second slide member 14 is inserted into the second support member 52 of the first slide member 12, and the top wall 32 of the second slide member 14 is not inserted into the first support member 50 of the first slide member 12. That is to say, the first guiding surface 38 of the second slide member 14 is not contact with the first guiding portion 70 of the first support member 50, the first engaging portion 56 of the first slide member 44 is not pushed by the top wall 32 of the second slide member 14. The first stop member 44 is maintained stationary. The first stop portion 58 holds against the second stop wall 86 and located in the guiding passage 30 of the first slide member 12. Therefore, when the bottom wall 34 of the second slide member 14 slides along the second support member 52 of the first slide member 12, the second slide member 14 only pushes the second engaging portion 60 of the second stop member 46 and passes. The bottom wall 34 is stopped by the first stop portion 58 of the first stop member 44 and cannot move further, as shown in FIG. 8. Accordingly, once the second slide member 14 is not correctly inserted in the first slide member 12, the assembler is acknowledged this situation by the first stop member 44 located at the trace that the second slide member 14 is slidably connected to the first slide member 12, the assembler then removes the second slide member 14 and installs the second slide member 14 to the first slide member 12 again. The second slide member 14 will not be installed in an incorrect way to cause any possible risk because of the incorrect installation.

Figure 9:
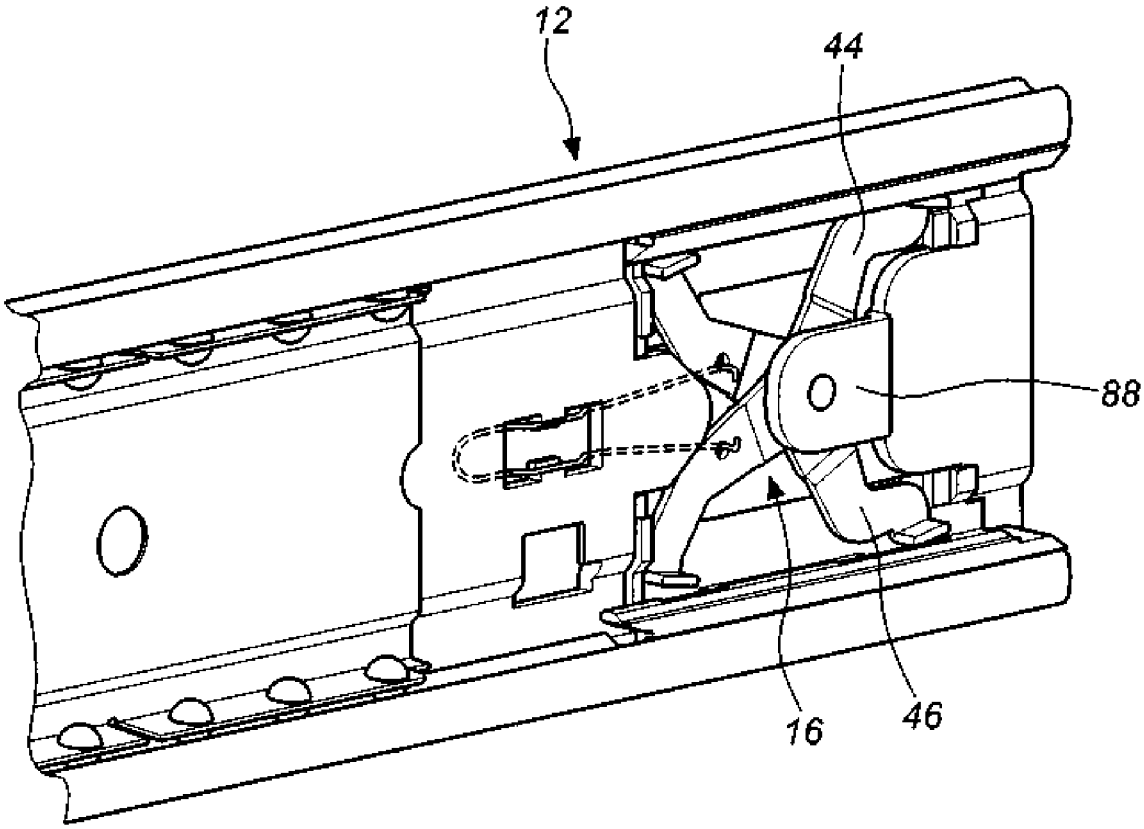
FIG. 9 shows a second embodiment of the security device of the present invention.

It is noted that the first and second stop members 44, 46 of the security device 16 are movably connected to the first slide member 12, so that the first and second stop members 44, 46 can be movably connected to a fixing plate 88 extending from the first slide member 12 as shown in FIG. 9. Alternatively, the first and second support members 50, 52 of the security device 16 can be combined as a main support member 90 which includes a bridge portion 92. The first and second stop members 44, 46 are movably connected to the bridge portion 92 so as to be movable relative to the first slide member 12, as shown in FIG. 10.

Figure 10:
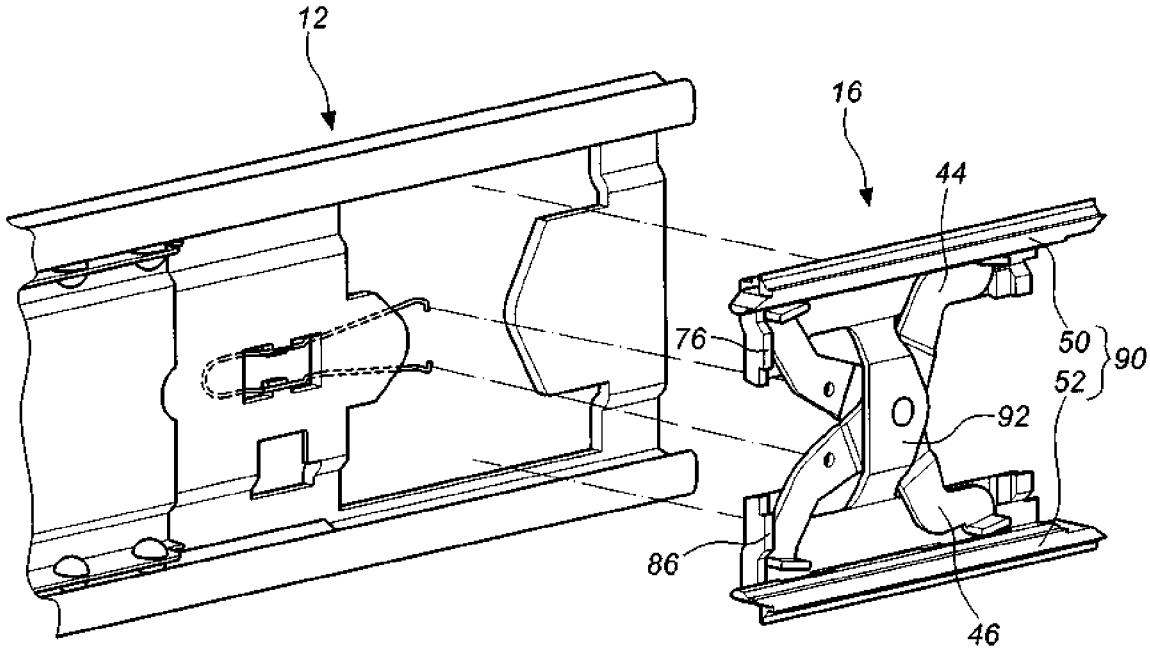
FIG. 10 shows a third embodiment of the security device of the present invention.
Figure 11:
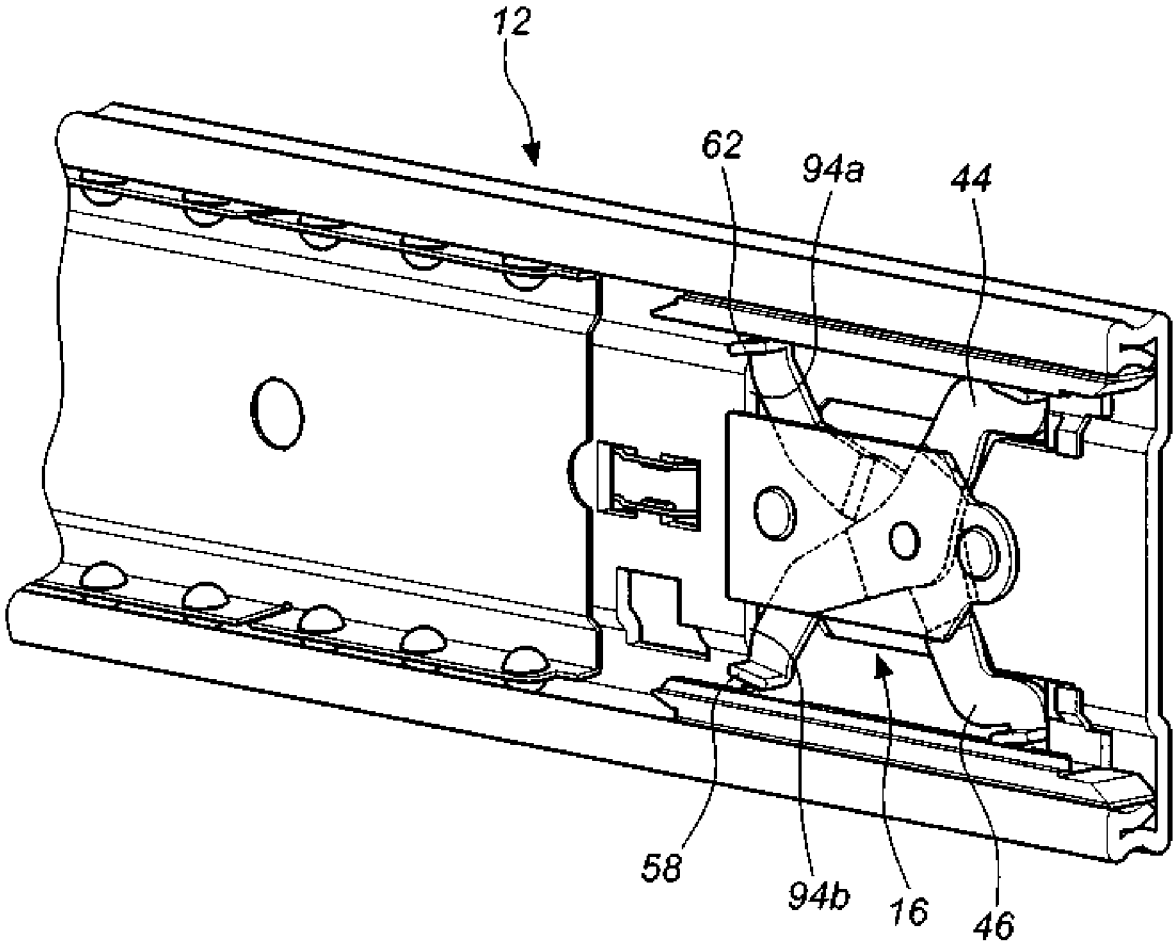
FIG. 11 shows a fourth embodiment of the security device of the present invention.
Figure 12:
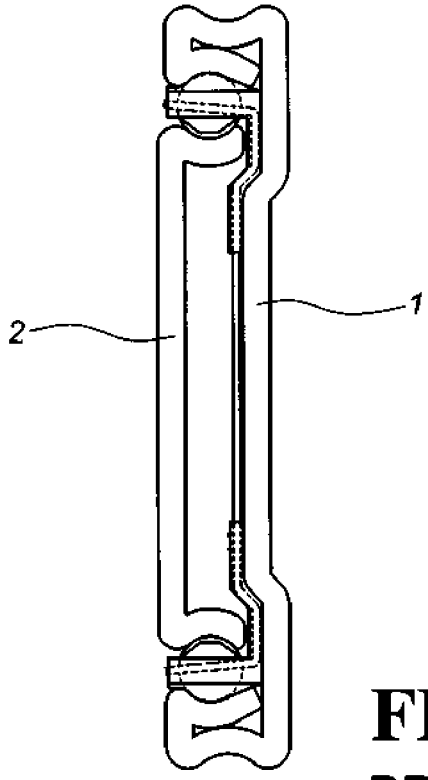
FIG. 12 PRIOR ART
FIG. 12 shows a conventional slide assembly.
Figure 13:
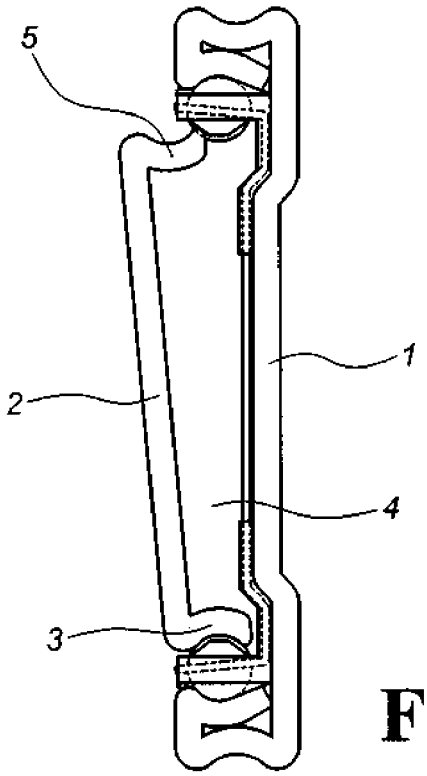
FIG. 13 PRIOR ART
FIG. 13 shows that the conventional slide assembly is not correctly assembled.

Referring to FIGS. 10 and 11, the first stop wall 76 of the first support member 50 of the security device 16 can be replaced by a first stop wall 94*a* provided on the first slide member 12. The second stop wall 86 of the second support member 52 can also be replaced by a second stop wall 94*b* provided on the first slide member 12. The first and second stop walls 94*a*, 94*b* stop the first and second stop members 44, 46 so as to position the first and second stop portions 58, 62 relative to the first slide member 12 when in the initial status.

While we have shown and described the embodiment in accordance with the present invention, it should be clear to those skilled in the art that further embodiments may be made without departing from the scope of the present invention.

What is claimed is:

1. A slide assembly, comprising:

a first slide member including a first wall, a second wall, a connection board connected between the first and second walls, a first passage defined by the first wall and the connection board, a second passage defined by the second wall and the connection board, each passage defined so as to accommodate rolling mediums, a guiding passage defined between the rolling mediums of the first passage and the rolling mediums of the second passage;

a second slide member including a top wall, a bottom wall and a side board connected between the top and bottom walls, a first guiding surface defined by the top wall and a second guiding surface defined by the bottom wall, the second slide member being inserted in the first slide member via the guiding passage, the first and second guiding surfaces being in contact with the rolling mediums of the first and second passages so that the second slide member is slidable relative to the first slide member;

a first stop member movably located at an initial end of the first slide member, and the second slide member being slidably connected to the first slide member from the initial end, the first stop member including a first engaging portion and a first stop portion located opposite to the first engaging portion, the first engaging portion and the first stop portion of the first stop member being located corresponding to the guiding passage of the first slide member;

a second stop member movably located at the initial end of the first slide member, and the second slide member being slidably connected to the first slide member from the initial end, the second stop member including a second engaging portion and a second stop portion located opposite to the second engaging portion, the second engaging portion and the second stop portion of the second stop member being located corresponding to the guiding passage of the first slide member, and an elastic member connected to the first and second stop members to maintain the first engaging portion and the first stop portion of the first stop member in their respective locations corresponding to the guiding passage of the first slide member, and the second engaging portion and the second stop portion of the second stop member in their respective locations corresponding to the guiding passage of the first slide member;

wherein a first stop wall is located corresponding to the second stop portion of the second stop member, and a second stop wall is located corresponding to the first stop portion of the first stop member, so as to hold against the second stop portion and the first stop portion, respectively;

wherein when the second slide member is inserted in the first slide member via the guiding passage, the first engaging portion and the second engaging portion of the first and second stop members are pushed by the second slide member to disengage from the guiding passage, the first stop portion of the first stop member is disengaged from the guiding passage of the first slide member and the second stop portion of the second stop member is disengaged from the guiding passage of the first slide member.

2. The slide assembly as claimed in claim 1, wherein the first and second stop members are pivotably connected to the first slide member, and the first and second stop members are crosswise connected to each other.

3. The slide assembly as claimed in claim 1, wherein the first engaging portion of the first stop member is located corresponding to the top wall of the second slide member and the second engaging portion of the second stop member is located corresponding to the bottom wall of the second slide member.

4. The slide assembly as claimed in claim 1, further comprising a fixing plate fixed to the first slide member, the first and second stop members being pivotably connected to the fixing plate so that the first engaging portion and the first stop portion of the first stop member and the second engaging portion and the second stop portion of the second stop member are movable relative to the first slide member.

5. The slide assembly as claimed in claim 4, wherein the first stop member has a first pivot hole located between the first engaging portion and the first stop portion, the second stop member has a second pivot hole located between the second engaging portion and the second stop portion, and the first and second stop members are pivotably connected to the fixing plate by the first and second pivot holes.

6. The slide assembly as claimed in claim 1, wherein the elastic member includes a first portion, a second portion located corresponding to the first portion and a middle portion connected between the first and second portions, a biasing force is formed between the first and second portions, the middle portion is connected to the first slide member, the first portion is connected to the first stop member, and the second portion is connected to the second stop member.

7. The slide assembly as claimed in claim 1, further comprising a first support member fixed to the first slide member adjacent to the first wall, the first support member including a first guiding portion, a first chamber and a second chamber, the first guiding portion being in contact with the first guiding surface of the second slide member, the first chamber accommodating the first engaging portion of the first stop member, the second chamber accommodating the second stop portion of the second stop member, the first stop wall being located adjacent to the second chamber; a second support member fixed to the first slide member adjacent to the second wall, the second support member including a second guiding portion, a third chamber and a fourth chamber, the second guiding portion being in contact with the second guiding surface of the second slide member, the third chamber accommodating the second engaging portion of the second stop member, the fourth chamber accommodating the and first stop portion of the first stop member, the second stop wall being located adjacent to the fourth chamber.

8. The slide assembly as claimed in claim 7, wherein the first and second support members are combined to be a main support member which includes a bridge portion, and the first and second stop members are movably connected to the bridge portion so as to be movable relative to the first slide member.

9. The slide assembly as claimed in claim 1, wherein the first and second stop walls are disposed on the first slide member.

10. A slide assembly with a security device, comprising a first slide member having an initial end and a second slide member connected to the first slide member from the initial end, the security device being connected to the initial end of the first slide member, the security device comprising:

a fixing plate fixed to the first slide member;

a first stop member pivotally connected to the fixing plate, the first stop member including a first engaging portion and a first stop portion located opposite to the first engaging portion;

a second stop member pivotally connected to the fixing plate, the second stop member including a second engaging portion and a second stop portion located opposite to the second engaging portion, the first and second stop members being crosswise connected to the fixing plate;

an elastic member including a first portion, a second portion located corresponding to the first portion, and a middle portion connected between the first and second portions, a biasing force being formed between the first and second portions, the first portion of the elastic member being connected to the first stop member and the second portion of the elastic member being connected to the second stop member;

a first support member fixed to the first slide member, the first support member including a first guiding portion, a first chamber, a second chamber, and a first stop wall located adjacent to the second chamber, the first chamber accommodating the first engaging portion of the first stop member, the second chamber accommodating the second stop portion of the second stop member, the first stop wall being adapted for the second stop member to lean against the first stop wall, and a second support member fixed to the first slide member, the second support member including a second guiding portion, a third chamber, a fourth chamber and a second stop wall located adjacent to the fourth chamber, the third chamber accommodating the second engaging portion of the second stop member, the fourth chamber accommodating the first stop portion of the first stop member, the second stop wall being adapted for the first stop member to lean against the second stop wall.

* * * * *